US011515062B2

(12) United States Patent
Hirota

(10) Patent No.: US 11,515,062 B2
(45) Date of Patent: Nov. 29, 2022

(54) COMPRESSED STRANDED CONDUCTOR, INSULATED ELECTRIC WIRE, AND WIRE HARNESS

(71) Applicant: YAZAKI CORPORATION, Tokyo (JP)

(72) Inventor: Tomomi Hirota, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/530,738

(22) Filed: Nov. 19, 2021

(65) Prior Publication Data

US 2022/0165452 A1 May 26, 2022

(30) Foreign Application Priority Data

Nov. 25, 2020 (JP) ..... JP2020-194899

(51) Int. Cl.

| | |
|---|---|
| ***H01B 7/18*** | (2006.01) |
| ***H01B 7/00*** | (2006.01) |
| ***H01B 7/02*** | (2006.01) |
| ***H01B 13/02*** | (2006.01) |

(52) U.S. Cl.

CPC ..... *H01B 7/18* (2013.01); *H01B 7/0045* (2013.01); *H01B 7/0216* (2013.01); *H01B 13/02* (2013.01)

(58) Field of Classification Search

USPC ..... 174/36

See application file for complete search history.

(56) References Cited

U.S. PATENT DOCUMENTS

| | | | | |
|---|---|---|---|---|
| 5,449,861 | A * | 9/1995 | Fujino | H01B 13/0285 174/113 A |
| 2002/0005036 | A1* | 1/2002 | Kim | D07B 1/0686 57/216 |
| 2016/0071633 | A1 | 3/2016 | Uchida | |
| 2016/0133356 | A1* | 5/2016 | Kondo | H01B 13/0006 174/72 A |
| 2019/0259511 | A1* | 8/2019 | Ooi | H01B 5/08 |
| 2020/0335240 | A1* | 10/2020 | Ooi | H01B 7/17 |
| 2021/0020328 | A1 | 1/2021 | Furuta | |

FOREIGN PATENT DOCUMENTS

| | | | |
|---|---|---|---|
| JP | 2014-199817 | A | 10/2014 |
| JP | 2014-229358 | A | 12/2014 |
| WO | 2019/163541 | A1 | 8/2019 |

* cited by examiner

*Primary Examiner* — William H. Mayo, III

(74) *Attorney, Agent, or Firm* — Sughrue Mion, PLLC

(57) ABSTRACT

A compressed stranded conductor includes an inner layer strand having conductive wires which are twisted together, and an outer layer strand having conductive wires which are arranged around an outer periphery of the inner layer strand and are twisted together. The inner layer strand and the outer layer strand are compressed. An inner layer area reduction rate of one conductive wire of the inner layer strand is 29% or more and 32% or less. An outer layer area reduction rate of one conductive wire of the outer layer strand is 6% or more and 11% or less. A difference between the inner layer area reduction rate and the outer layer area reduction rate is 19% or more and 25% or less.

4 Claims, 4 Drawing Sheets

FIG. 3

| NAME OF ELECTRIC WIRE | COMPRESSED STRANDED CONDUCTOR | | | | | | | | THICKNESS OF INSULATOR | | FINISHED OUTER DIAMETER | | CONDUCTOR RESISTANCE |
|---|---|---|---|---|---|---|---|---|---|---|---|---|---|
| | WIRE CONFIGU-RATION (PIECE/SHAPE) | INPUT WIRE DIAMETER (mm) | TWIST PITCH (mm) | INNER LAYER CONFIGU-RATION (PIECE) | OUTER LAYER CONFIGU-RATION (PIECE) | TWIST DIREC-TION | CROSS-SECTION-AL AREA ($mm^2$) | OUTER DIAMETER (mm) | MINIMUM (mm) | STAND-ARD (mm) | STAND-ARD (mm) | MAXI-MUM (mm) | MAXIMUM (mΩ/m) |
| 2sq | 17/ CIRCULAR COMPRES-SION | 0.417 | 34±3 | 7 | 10 | S | 1.88 | 1.65 | 0.23 | 0.25 | 2.2 | 2.4 | 16.3 |
| 2.5sq | 17/ CIRCULAR COMPRES-SION | 0.505 | 40±3 | 7 | 10 | S | 2.75 | 1.95 | 0.23 | 0.25 | 2.2 | 2.7 | 12 |

FIG. 4

| | COMPARATIVE EXAMPLE 1 | EXAMPLE 1 | EXAMPLE 2 | EXAMPLE 3 | COMPARATIVE EXAMPLE 2 |
|---|---|---|---|---|---|
| WIRE DIAMETER | 0.49mm | 0.49mm | 0.49mm | 0.49mm | 0.49mm |
| INNER LAYER STRAND DIAMETER | 1.13mm | 1.16mm | 1.19mm | 1.20mm | 1.22mm |
| OUTER LAYER STRAND DIAMETER | 1.96mm | 1.96mm | 1.96mm | 1.96mm | 1.96mm |
| INNER LAYER AREA REDUCTION RATE | 33% | 30% | 28% | 27% | 25% |
| OUTER LAYER AREA REDUCTION RATE | 6% | 7% | 8% | 8% | 11% |
| DIFFERENCE BETWEEN AREA REDUCTION RATES | 27% | 23% | 20% | 19% | 14% |
| RESULT | INNER LAYER BREAKAGE | GOOD | BETTER | GOOD | UNTWISTING |

FIG. 5

| | COMPARATIVE EXAMPLE 3 | EXAMPLE 4 | EXAMPLE 5 | EXAMPLE 6 | COMPARATIVE EXAMPLE 4 |
|---|---|---|---|---|---|
| WIRE DIAMETER | 0.49mm | 0.49mm | 0.49mm | 0.49mm | 0.49mm |
| INNER LAYER STRAND DIAMETER | 1.19mm | 1.19mm | 1.19mm | 1.19mm | 1.19mm |
| OUTER LAYER STRAND DIAMETER | 1.90mm | 1.93mm | 1.95mm | 1.98mm | 2.01mm |
| INNER LAYER AREA REDUCTION RATE | 32% | 32% | 30% | 29% | 29% |
| OUTER LAYER AREA REDUCTION RATE | 15% | 10% | 7% | 6% | 4% |
| DIFFERENCE BETWEEN AREA REDUCTION RATES | 17% | 22% | 23% | 23% | 25% |
| RESULT | OUTER LAYER BREAKAGE | GOOD | BETTER | GOOD | UNTWISTING |

FIG. 6

| | DIFFERENCE BETWEEN AREA REDUCTION RATES (%) | INNER LAYER COMPRESSION RATE (%) | OUTER LAYER COMPRESSION RATE (%) | RESULT | REASON |
|---|---|---|---|---|---|
| EXAMPLE 7 | 19 | 87 | 89 | GOOD | – |
| EXAMPLE 8 | 21 | 85 | 94 | GOOD | – |
| EXAMPLE 9 | 22 | 85 | 91 | GOOD | – |
| EXAMPLE 10 | 22 | 87 | 91 | GOOD | – |
| EXAMPLE 11 | 22 | 95 | 91 | GOOD | – |
| EXAMPLE 12 | 23 | 87 | 89 | GOOD | – |
| EXAMPLE 13 | 25 | 87 | 95 | GOOD | – |
| COMPARATIVE EXAMPLE 5 | 16 | 89 | 88 | UNTWISTING | INSUFFICIENT COMPRESSION |
| COMPARATIVE EXAMPLE 6 | 18 | 85 | 93 | UNTWISTING | INSUFFICIENT COMPRESSION |
| COMPARATIVE EXAMPLE 7 | 18 | 88 | 89 | UNTWISTING | INSUFFICIENT COMPRESSION |
| COMPARATIVE EXAMPLE 8 | 26 | 96 | 91 | WIRE BREAKAGE | OVER-COMPRESSION |
| COMPARATIVE EXAMPLE 9 | 26 | 87 | 96 | WIRE BREAKAGE | OVER-COMPRESSION |

COMPRESSED STRANDED CONDUCTOR, INSULATED ELECTRIC WIRE, AND WIRE HARNESS

CROSS-REFERENCE TO RELATED APPLICATIONS

This application is based on and claims priority under 35 USC 119 from Japanese Patent Application No. 2020-194899 filed on Nov. 25, 2020, the contents of which are incorporated herein by reference.

TECHNICAL FIELD

The present disclosure relates to a compressed stranded conductor, an insulated electric wire, and a wire harness.

BACKGROUND ART

In the related art, it has been proposed that a stranded conductor obtained by twisting a plurality of wires together is compressed for the purpose of reducing a diameter or the like to form a compressed stranded conductor (see, for example, WO 2019/163541, JP-A-2014-229358, and JP-A-2014-199817).

However, in the inventions disclosed in WO 2019/163541, JP-A-2014-229358, and JP-A-2014-199817, a strand is compressed according to a compression rate, but an area reduction rate indicating a compressed state of the wires forming the strand is not considered at all. Therefore, a part of the wires are excessively compressed (over-compressed), leading to wire breakage, or a part of the wires may be untwisted due to insufficient compression.

SUMMARY OF INVENTION

The present disclosure has been made to solve such a problem in the related art, and an object of the present disclosure is to provide a compressed stranded conductor, an insulated electric wire, and a wire harness that can reduce a possibility of wire breakage and untwisting.

Aspect of non-limiting embodiments of the present disclosure relates to provide a compressed stranded conductor including:

an inner layer strand having a plurality of conductive wires which are twisted together; and an outer layer strand having a plurality of conductive wires which are arranged around an outer periphery of the inner layer strand and are twisted together so as to form a layer, in which the inner layer strand and the outer layer strand are compressed;

an inner layer area reduction rate, which is a difference between 100% and a value (%) obtained by dividing a wire cross-sectional area of one conductive wire of the inner layer strand after compression of the inner layer strand by a wire cross-sectional area of one conductive wire of the inner layer strand before compression of the inner layer strand, is 29% or more and 32% or less;

an outer layer area reduction rate, which is a difference between 100% and a value (%) obtained by dividing a wire cross-sectional area of one conductive wire of the outer layer strand after compression of the outer layer strand by a wire cross-sectional area of one conductive wire of the outer layer strand before compression of the outer layer strand, is 6% or more and 11% or less; and a difference between the inner layer area reduction rate and the outer layer area reduction rate is 19% or more and 25% or less.

According to the present disclosure, it is possible to reduce a possibility of wire breakage and untwisting.

BRIEF DESCRIPTION OF DRAWINGS

FIG. 3 is a table showing an example of the insulated electric wire according to the present embodiment.

FIG. 4 is a first table showing Examples and Comparative Examples.

FIG. 5 is a second table showing Examples and Comparative Examples.

FIG. 6 is a third table showing Examples and Comparative Examples.

DESCRIPTION OF EMBODIMENTS

Hereinafter, the present disclosure will be described in accordance with a preferred embodiment. The present disclosure is not limited to the embodiment to be described below, and can be changed as appropriate without departing from the spirit of the present disclosure. In addition, although some configurations are not shown or described in the embodiment to be described below, it goes without saying that a known or well-known technique is applied as appropriate to details of an omitted technique within a range in which no contradiction occurs to contents to be described below.

Figure 1:
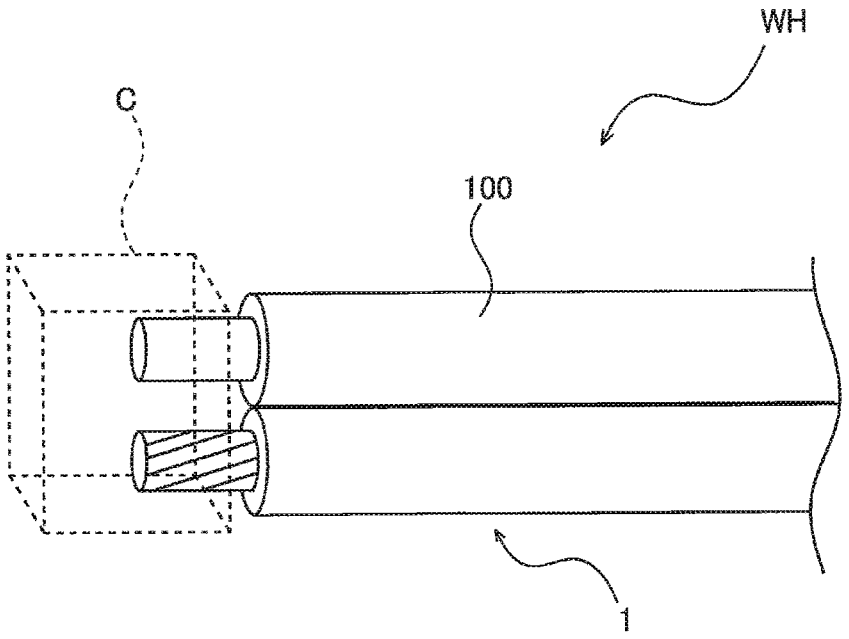
FIG. 1 is a configuration diagram showing an example of a wire harness including an insulated electric wire according to an embodiment of the present disclosure.

FIG. 1 is a configuration diagram showing an example of a wire harness including an insulated electric wire according to an embodiment of the present disclosure. As shown in FIG. 1, a wire harness WH includes an insulated electric wire 1 described in detail below and another insulated electric wire (another electric wire) 100.

In the insulated electric wire 1 and the another insulated electric wire 100, for example, terminals (not shown) are crimped or the like, and then the terminals are accommodated in a terminal accommodating chamber of a connector C to form the wire harness WH. The insulated electric wire 1 and the another insulated electric wire 100 may be attached with an exterior member such as a corrugated tube (not shown) or wrapped with tape. The wire harness WH may include two or more insulated electric wires 1, or two or more the another insulated electric wires 100. The connector C is not essential for the wire harness WH.

Figure 2:
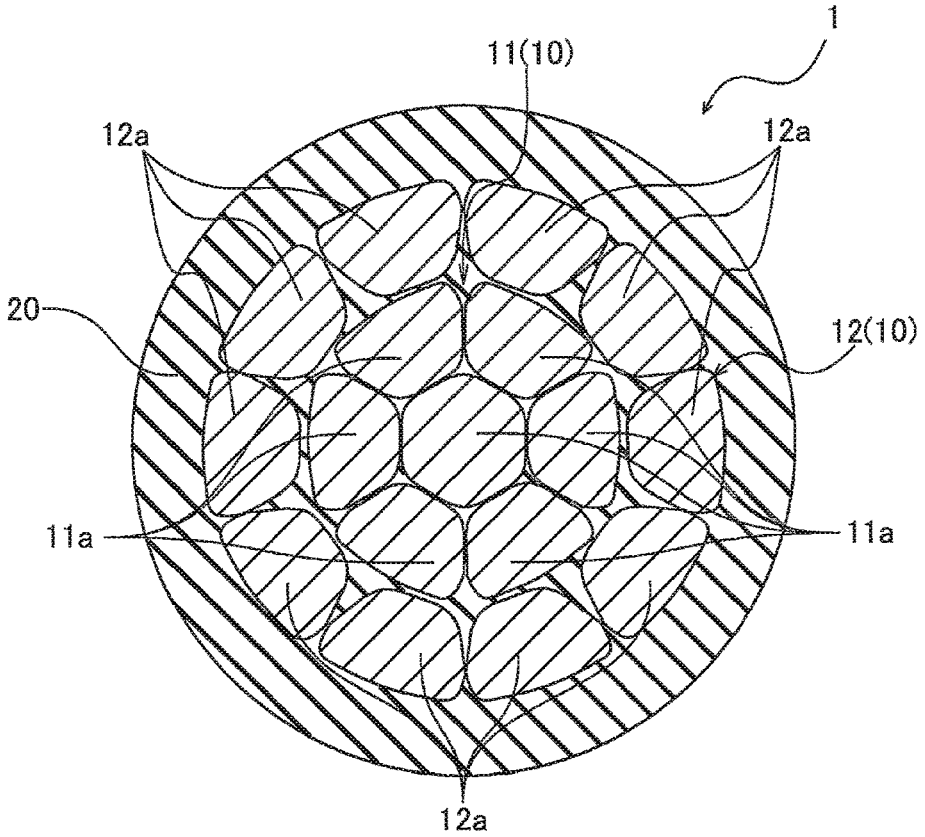
FIG. 2 is a structural view showing the insulated electric wire shown in FIG. 1.

FIG. 2 is a structural view showing the insulated electric wire 1 shown in FIG. 1. As shown in FIG. 2, the insulated electric wire 1 includes a compressed stranded conductor 10 and an insulator 20 covering a periphery of the compressed stranded conductor 10 obtained by a compression process.

The compressed stranded conductor 10 is formed by twisting a plurality of wires 11*a* and 12*a* together and compressing the plurality of wires 11*a* and 12*a*. The compressed stranded conductor 10 includes an inner layer strand 11 and an outer layer strand 12. The inner layer strand 11 is formed by twisting a plurality of conductive wires 11*a* together. In the present embodiment, the inner layer strand 11 is formed by twisting seven wires 11*a* made of an aluminum alloy together. The wire 11*a* is not limited to the aluminum alloy, and may be made of aluminum, copper, a copper alloy, or the like.

The outer layer strand 12 is formed by twisting a plurality of conductive wires 12*a* together on an outer periphery of the inner layer strand 11 and disposing the plurality of conductive wires 12*a* in layers. In the present embodiment, the outer layer strand 12 is formed by twisting ten wires 12*a* made of an aluminum alloy together. The wire 12*a* is not limited to the aluminum alloy similarly to the wire 11*a* of the inner layer strand 11, and may be made of aluminum, copper, a copper alloy, or the like. The outer layer strand 12 may be formed in two or more layers.

Such inner layer strand 11 and outer layer strand 12 are compressed. The inner layer strand 11 and the outer layer strand 12 are compressed separately. First, the inner layer strand 11 is compressed, then the wires 12*a* are disposed on the compressed inner layer strand 11 to form the outer layer strand 12, and then the outer layer strand 12 is compressed. The inner layer strand 11 is compressed together relative to the compression of the outer layer strand 12. Here, each of the inner layer strand 11 and the outer layer strand 12 is not limited to one compression, but may be compressed twice or more. That is, in the compressed stranded conductor 10 according to the present embodiment, if the inner layer strand 11 and the outer layer strand 12 are each compressed once, and a total number of compressions is a plurality of times, the number of compressions does not matter. Further, in the present embodiment, the inner layer strand 11 and the outer layer strand 12 are each assumed to be compressed by a compression die, but the compression is not particularly limited to the compression die.

Here, in the inner layer strand 11 and the outer layer strand 12 according to the present embodiment, an area reduction rate indicating a compressed state of the wires 11*a* and 12*a* is optimized, and wire breakage and untwisting are prevented. That is, an inner layer area reduction rate (average value of a plurality of wires 11*a*), which is a difference between 100% and a value (%) obtained by dividing a wire cross-sectional area of the conductive wire of the inner layer strand 11 after compression of the inner layer strand 11 by a wire cross-sectional area of the conductive wire of the inner layer strand 11 before compression of the wires 11*a* of the inner layer strand 11, and which is 1−(cross-sectional area of the wire 11*a* of the inner layer strand 11 after compression)/(cross-sectional area of the wire 11*a* of the inner layer strand 11 before compression) (%), is 29% or more and 32% or less, an outer layer area reduction rate (average value of a plurality of wires 12*a*), which is a difference between 100% and a value (%) obtained by dividing a wire cross-sectional area of the wire 12*a* of the outer layer strand 12 after compression of the outer layer strand 12 by a wire cross-sectional area of the conductive wire of the outer layer strand 12 before compression of the wires 12*a* of the outer layer strand 12, and which is 1−(cross-sectional area of the wire 12*a* after compression of the outer layer strand 12)/(cross-sectional area of the wire 12*a* of the outer layer strand 12 before compression of the outer layer strand 12) (%), is 6% or more and 11% or less, and a difference between the inner layer area reduction rate and the outer layer area reduction rate is 19% or more and 25% or less.

Here, the inventors of the present disclosure find that when the inner layer area reduction rate is less than 29%, the wire 11*a* of the inner layer strand 11 tend to be untwisted, and when the inner layer area reduction rate exceeds 32%, the inner layer strand 11 tends to break due to over-compression. In addition, the inventors of the present disclosure find that when the outer layer area reduction rate is less than 6%, the wire 12*a* of the outer layer strand 12 tend to be untwisted, and when the outer layer area reduction rate exceeds 11%, the outer layer strand 12 tends to break due to over-compression. Further, the inventors of the present disclosure find that when the difference between the inner layer area reduction rate and the outer layer area reduction rate exceeds 25%, a break due to the over-compression tends to occur in either the wire 11*a* of the inner layer strand 11 or the wire 12*a* of the outer layer strand 12. In addition, the inventors of the present disclosure find that when the difference between the inner layer area reduction rate and the outer layer area reduction rate is less than 19%, untwisting due to insufficient compression tends to occur in either the inner layer strand 11 or the outer layer strand 12. Therefore, in the compressed stranded conductor 10 according to the present embodiment, by setting the inner layer area reduction rate to 29% or more and 32% or less, the outer layer area reduction rate to 6% or more and 11% or less, and the difference between the inner layer area reduction rate and the outer layer area reduction rate to 19% or more and 25% or less, a possibility of the wire breakage and the untwisting is reduced.

Further, in the compressed stranded conductor 10 according to the present embodiment, an inner layer compression rate, which is a compression rate of the inner layer strand 11, is 85% or more and 95% or less. The inner layer compression rate refers to a ratio of a value obtained by dividing a weight of the inner layer strand 11 after compression cut to 1 meter (per 1 meter) by a specific gravity of conductor material of the wires 11*a* to a value obtained by multiplying a square of a conductor radius of the inner layer strand 11 after compression by $\pi$.

In the compressed stranded conductor 10 according to the present embodiment, an outer layer compression rate, which is a compression rate of the outer layer strand 12, is 89% or more and 95% or less. The outer layer compression rate refers to a ratio of a value obtained by dividing a weight of the outer layer strand 12 after compression cut to 1 meter (per 1 meter) by a specific gravity of conductor material of the wires 12*a* of the outer layer strand 12 to a value obtained by subtracting the value obtained by multiplying the square of the conductor radius of the inner layer strand 11 after compression by $\pi$ from a value obtained by multiplying a square of a conductor radius of the outer layer strand 12 after compression by $\pi$.

Thus, since the inner layer compression rate is 85% or more and the outer layer compression rate is 89% or more, when the compression is performed with the compression die without excessively decreasing a value of the compression rate, the wire can easily pass through the compression die, and production can be performed with good workability. In addition, since the inner layer compression rate and the outer layer compression rate are 95% or less, it is possible to manufacture the wires 11*a* and 12*a* without excessively increasing the value of the compression rate and without over-compressing and breaking the wires 11*a* and 12*a*.

FIG. 3 is a table showing an example of the insulated electric wire 1 according to the present embodiment. As shown in FIG. 3, the insulated electric wire 1 of 2 sq (name of electric wire) according to the present embodiment is formed of 17 pieces of wires 11*a* and 12*a* in which the compressed stranded conductor 10 is circularly compressed. A diameter of each of the wires 11*a* and 12*a* is 0.417 mm, and a twist pitch is 34±3 mm. The inner layer strand 11 is formed of seven wires 11*a*, and the outer layer strand 12 is formed of ten wires 12*a*. A twist direction of the inner layer strand 11 and the outer layer strand 12 is an S direction. A cross-sectional area of the compressed stranded conductor 10 is 1.88 $mm^2$, and an outer diameter of the compressed stranded conductor 10 is 1.65 mm. A minimum thickness of the insulator 20 is 0.23 mm, and a standard thickness of the insulator 20 is 0.25 mm. A finished outer diameter is 2.2 mm as a standard and 2.4 mm at maximum. A maximum conductor resistance is 16.3 mΩ/m.

The insulated electric wire 1 of 2.5 sq (name of electric wire) according to the present embodiment is formed of 17 pieces of wires 11*a* and 12*a* in which the compressed stranded conductor 10 is circularly compressed. A diameter of each of the wires 11*a* and 12*a* is 0.505 mm, and a twist pitch is 40±3 mm. The inner layer strand 11 is formed of seven wires 11*a*, and the outer layer strand 12 is formed of ten wires 12*a*. The twist direction of the inner layer strand 11 and the outer layer strand 12 is the S direction. The cross-sectional area of the compressed stranded conductor 10 is 2.75 $mm^2$, and the outer diameter of the compressed stranded conductor 10 is 1.95 mm. The minimum thickness of the insulator 20 is 0.23 mm, and the standard thickness of the insulator 20 is 0.25 mm. The finished outer diameter is 2.2 mm as a standard and 2.7 mm at maximum. The maximum conductor resistance is 12 mΩ/m. FIG. 3 shows an example of the insulated electric wire, and the insulated electric wire 1 according to the present embodiment is not limited to the one shown in FIG. 3.

Next, a method of manufacturing the insulated electric wire 1 according to the present embodiment will be described. First, an inner layer wire twisting step is performed. In this step, a plurality of (for example, seven) wires 11*a* are twisted together to form the inner layer strand 11 before compression.

Next, an inner layer compression step is performed. In this step, for example, compression is performed by a first compression die. The compressed inner layer strand 11 is obtained in this step. The inner layer compression rate is 85% or more and 95% or less, and the inner layer area reduction rate is also optimized.

Next, an outer layer wire twisting step is performed. In this step, a plurality of (for example, ten) wires 12*a* are twisted together and disposed on the outer periphery of the inner layer strand 11 after compression.

Thereafter, an outer layer compression step is performed. In this step, for example, compression is performed by a second compression die. The compressed outer layer strand 12 is obtained in this step. The outer layer compression rate is 89% or more and 95% or less. Further, at this point in time, the inner layer area reduction rate is 29% or more and 32% or less, the outer layer area reduction rate is 6% or more and 11% or less, and the difference between the inner layer area reduction rate and the outer layer area reduction rate to 19% or more and 25% or less.

The inner layer compression step and the outer layer compression step are each one compression step, but the present disclosure is not limited thereto, and each compression step may be a step in which the compression is performed stepwise by using a plurality of compression dies.

Next, an annealing treatment is performed. In this treatment, the compressed inner layer strand 11 and the compressed outer layer strand 12 are annealed at a predetermined temperature or higher for a predetermined time or longer. Accordingly, the compressed stranded conductor 10 is obtained. Thereafter, a coating treatment is performed to obtain the insulated electric wire 1 according to the present embodiment.

Next, Examples and Comparative Examples will be described. In the Examples and Comparative Examples, the wires are made of the aluminum alloy. The aluminum alloy has Si of 0.10 mass % or less and Fe of 0.55 mass % or more and 0.65 mass % or less. Mg is 0.28 mass % or more and 0.32 mass % or less, Zr is 0.005 mass % or more and 0.01 mass % or less, and Ti+V is 0.02 mass % or less. In such a wire, a wire diameter is 0.303 mm or more and 0.322 mm or less, a strength is 0.28 MPa or more and 0.32 MPa or less, and an elongation is 0.005% or more and 0.01% or less.

FIG. 4 is a first table showing Examples and Comparative Examples. Examples 1 to 3 and Comparative Examples 1 and 2 shown in FIG. 4 show measurement results when the inner layer area reduction rate was set to a value within a suitable range and a value outside the suitable range while the outer layer area reduction rate was set to a value within a suitable range for an insulated electric wire different from the insulated electric wire shown in FIG. 3.

In Examples 1 to 3 and Comparative Examples 1 and 2 shown in FIG. 4, the wire diameter is 0.49 mm, and an outer layer strand diameter is 1.96 mm.

Here, in Example 1, an inner layer strand diameter was 1.16 mm, the inner layer area reduction rate was 30%, and the outer layer area reduction rate was 7%. Therefore, the difference between the area reduction rates was 23%. Here, in Example 2, the inner layer strand diameter was 1.19 mm, the inner layer area reduction rate was 28%, and the outer layer area reduction rate was 8%. Therefore, the difference between the area reduction rates was 20%. Further, in Example 3, the inner layer strand diameter was 1.20 mm, the inner layer area reduction rate was 27%, and the outer layer area reduction rate was 8%. Therefore, the difference between the area reduction rates was 19%.

On the other hand, in Comparative Example 1, the inner layer strand diameter was 1.13 mm, the inner layer area reduction rate was 33%, and the outer layer area reduction rate was 6%. Therefore, the difference between the area reduction rates was 27%. In Comparative Example 2, the inner layer strand diameter was 1.22 mm, the inner layer area reduction rate was 25%, and the outer layer area reduction rate was 11%. Therefore, the difference between the area reduction rates was 14%.

As described above, in Examples 1 to 3 and Comparative Examples 1 and 2, the outer layer area reduction rate is within a suitable range. In Examples 1 to 3, the inner layer area reduction rate and the difference between the area reduction rates are also values within suitable ranges. Therefore, in the insulated electric wires according to Examples 1 to 3, no breakage occurred in the inner and outer layer wires (even if there was a breakage, one wire or the like broke), and no untwisting occurred. In particular, with respect to the inner layer area reduction rate and the difference between the area reduction rates, in Example 2 in which the values were in the vicinity of median values in the suitable ranges, no breakage occurred and the twist was also appropriate, and the untwisting was less likely to occur than in Examples 1 and 3.

In contrast, in Comparative Example 1 in which the inner layer area reduction rate and the difference between the area reduction rates exceeded the suitable ranges, breakage was observed in an inner layer wire. In Comparative Example 2 in which the inner layer area reduction rate and the difference between the area reduction rates were less than the suitable ranges, the untwisting was observed.

From the above, it is also found that if all of the inner layer area reduction rate, the outer layer area reduction rate, and the difference between the area reduction rates are within suitable ranges, the possibility of the wire breakage and the possibility of the untwisting can be reduced.

FIG. 5 is a second table showing Examples and Comparative Examples. Examples 4 to 6 and Comparative Examples 3 and 4 shown in FIG. 5 show measurement results when the outer layer area reduction rate was set to a value within the suitable range and a value outside the suitable range while the inner layer area reduction rate was set to a value within a suitable range for an insulated electric wire different from the insulated electric wire shown in FIG. 3.

In Examples 4 to 6 and Comparative Examples 3 and 4 shown in FIG. 5, the wire diameter is 0.49 mm, and the inner layer strand diameter is 1.19 mm.

Here, in Example 4, the outer layer strand diameter was 1.93 mm, the inner layer area reduction rate was 32%, and the outer layer area reduction rate was 10%. Therefore, the difference between the area reduction rates was 22%. In Example 5, the outer layer strand diameter was 1.95 mm, the inner layer area reduction rate was 30%, and the outer layer area reduction rate was 7%. Therefore, the difference between the area reduction rates was 23%. Further, in Example 6, the outer layer strand diameter was 1.98 mm, the inner layer area reduction rate was 29%, and the outer layer area reduction rate was 6%. Therefore, the difference between the area reduction rates was 23%.

On the other hand, in Comparative Example 3, the outer layer strand diameter was 1.90 mm, the inner layer area reduction rate was 32%, and the outer layer area reduction rate was 15%. Therefore, the difference between the area reduction rates was 17%. In Comparative Example 4, the outer layer strand diameter was 2.01 mm, the inner layer area reduction rate was 29%, and the outer layer area reduction rate was 4%. Therefore, the difference between the area reduction rates was 25%.

As described above, in Examples 4 to 6 and Comparative Examples 3 and 4, the inner layer area reduction rate is within the suitable range. In Examples 4 to 6, the outer layer area reduction rate and the difference between the area reduction rates are also values within the suitable ranges. Therefore, in the insulated electric wires according to Examples 4 to 6, no breakage occurred in the inner and outer layer wires (even if there was a breakage, the breakage is slight), and no untwisting occurred. In particular, with respect to the outer layer area reduction rate and the difference between the area reduction rates, in Example 5 in which the values were in the vicinity of median values in the suitable ranges, no breakage occurred and the twist was also appropriate, and the untwisting was less likely to occur than in Examples 4 and 6.

In contrast, in Comparative Example 3 in which the outer layer area reduction rate exceeded the suitable range, and the difference between the area reduction rates is less than the suitable range, breakage was observed in an outer layer wire. In Comparative Example 4 in which the outer layer area reduction rate was less than the suitable range, the untwisting was observed. In particular, in Comparative Example 4, even though the difference between the area reduction rates was within the suitable range, the outer layer area reduction rate was less than the suitable range, and thus the untwisting occurred.

From the above, it is also found that if all of the inner layer area reduction rate, the outer layer area reduction rate, and the difference between the area reduction rates are within suitable ranges, the possibility of the wire breakage and the possibility of the untwisting can be reduced.

FIG. 6 is a third table showing Examples and Comparative Examples. In Examples 7 to 13 and Comparative Examples 5 to 9, in the compressed stranded conductor of the insulated electric wire of 2 sq (name of electric wire) shown in FIG. 3, the difference between the area reduction rates, the inner layer compression rate, and the outer layer compression rate were changed.

In the compressed stranded conductor of Example 7, the difference between the area reduction rates was 19%. In Example 7, the inner layer compression rate was 87%, and the outer layer compression rate was 89%. In the compressed stranded conductor of Example 8, the difference between the area reduction rates was 21%. In Example 8, the inner layer compression rate was 85%, and the outer layer compression rate was 94%. In the compressed stranded conductor of Example 9, the difference between the area reduction rates was 22%. In Example 9, the inner layer compression rate was 85%, and the outer layer compression rate was 91%. In the compressed stranded conductor of Example 10, the difference between the area reduction rates was 22%. In Example 10, the inner layer compression rate was 87%, and the outer layer compression rate was 91%.

In the compressed stranded conductor of Example 11, the difference between the area reduction rates was 22%. In Example 11, the inner layer compression rate was 95%, and the outer layer compression rate was 91%. In the compressed stranded conductor of Example 12, the difference between the area reduction rates was 23%. In Example 12, the inner layer compression rate was 87%, and the outer layer compression rate was 89%. In the compressed stranded conductor of Example 13, the difference between the area reduction rates was 25%. In Example 13, the inner layer compression rate was 87%, and the outer layer compression rate was 95%.

In the compressed stranded conductor of Comparative Example 5, the difference between the area reduction rates was 16%. In Comparative Example 5, the inner layer compression rate was 89%, and the outer layer compression rate was 88%. In the compressed stranded conductor of Comparative Example 6, the difference between the area reduction rates was 18%. In Comparative Example 6, the inner layer compression rate was 85%, and the outer layer compression rate was 93%. In the compressed stranded conductor of Comparative Example 7, the difference between the area reduction rates was 18%. In Comparative Example 7, the inner layer compression rate was 88%, and the outer layer compression rate was 89%.

In the compressed stranded conductor of Comparative Example 8, the difference between the area reduction rates was 26%. In Comparative Example 8, the inner layer compression rate was 96%, and the outer layer compression rate was 91%. In the compressed stranded conductor of Comparative Example 9, the difference between the area reduction rates was 26%. In Comparative Example 9, the inner layer compression rate was 87%, and the outer layer compression rate was 96%.

As described above, the compressed stranded conductors according to Examples 7 to 13 having the difference between the area reduction rates of 19% or more and 25% or less did not have the wire breakage due to the over-compression or the untwisting due to the insufficient compression. In contrast, in the compressed stranded conductors according to Comparative Examples 5 to 7 having the difference between the area reduction rates of less than 19%, untwisting occurred due to the insufficient compression. In the compressed stranded conductors according to Comparative Examples 8 and 9 in which the difference between the area reduction rates exceeded 26%, the wire breakage occurred due to the over-compression.

As described above, according to the compressed stranded conductor 10, the insulated electric wire 1, and the wire harness WH according to the present embodiment, the inner layer area reduction rate is 29% or more and 32% or less, the outer layer area reduction rate is 6% or more and 11% or less, and the difference between the inner layer area reduction rate and the outer layer area reduction rate is 19% or more and 25% or less. Here, the inventors of the present disclosure have found that, in the compressed stranded conductor 10 including the inner layer strand 11 and the outer layer strand 12, when the inner layer area reduction rate indicating the compressed state of the inner layer wire 11*a* and the outer layer area reduction rate indicating the compressed state of the outer layer wire 12*a* are within the above ranges, and the difference between the inner layer area reduction rate and the outer layer area reduction rate is 19% or more and 25% or less, it is possible to reduce the possibility of the over-compression and the insufficient compression. Therefore, it is possible to reduce the possibility of the wire breakage and the untwisting.

Since the inner layer compression rate is 85% or more and 95% or less, and the outer layer compression rate is 89% or more and 95% or less, when the compression is performed with the compression die without excessively decreasing the value of the compression rate, the wire can easily pass through the compression die, and the production can be performed with good workability. It is possible to manufacture the wires 11*a* and 12*a* without excessively increasing the value of the compression rate and without over-compressing and breaking the wires 11*a* and 12*a*.

Although the present disclosure has been described based on the embodiment, the present disclosure is not limited to the embodiment described above. The present disclosure may be modified as appropriate without departing from the gist of the present disclosure, or known and well-known techniques may be assembled as appropriate.

For example, the inner layer strand 11 according to the present embodiment is formed of, for example, seven wires 11*a*, and the outer layer strand 12 is formed of, for example, ten wires 12*a*, but the number is not particularly limited thereto.

Here, the features of the embodiment of the compressed stranded conductor according to the present disclosure described above will be briefly summarized and listed in the following [1] to [4].

[1] There is provided a compressed stranded conductor including:

an inner layer strand having a plurality of conductive wires which are twisted together; and an outer layer strand having a plurality of conductive wires which are arranged around an outer periphery of the inner layer strand and are twisted together so as to form a layer, in which the inner layer strand and the outer layer strand are compressed;

an inner layer area reduction rate, which is a difference between 100% and a value (%) obtained by dividing a wire cross-sectional area of the conductive wire of the inner layer strand after compression of the inner layer strand by a wire cross-sectional area of the conductive wire of the inner layer strand before compression of the inner layer strand, is 29% or more and 32% or less;

an outer layer area reduction rate, which is a difference between 100% and a value (%) obtained by dividing a wire cross-sectional area of the conductive wire of the outer layer strand after compression of the outer layer strand by a wire cross-sectional area of the conductive wire of the outer layer strand before compression of the outer layer strand, is 6% or more and 11% or less; and a difference between the inner layer area reduction rate and the outer layer area reduction rate is 19% or more and 25% or less.

[2] In the compressed stranded conductor according to the above item [1], an inner layer compression rate, which is a ratio of a value obtained by dividing a weight of the inner layer strand after compression per 1 meter by a specific gravity of material of the conductive wires of the inner layer strand to a value obtained by multiplying a square of a conductor radius of the inner layer strand after compression by $\pi$, is 85% or more and 95% or less, and an outer layer compression rate, which is a ratio of a value obtained by dividing a weight of the outer layer strand after compression per 1 meter by a specific gravity of material of the conductive wires of the outer layer strand to a value obtained by subtracting the value obtained by multiplying the square of the conductor radius of the inner layer strand after compression by $\pi$ from a value obtained by multiplying a square of a conductor radius of the outer layer strand after compression by $\pi$, is 89% or more and 95% or less.

[3] There is provided an insulated electric wire including:

the compressed stranded conductor according to the above item [1] or [2]; and an insulator covering a periphery of the compressed stranded conductor.

[4] There is provided a wire harness including:

the insulated electric wire according to the above item [3]; and another electric wire disposed along the insulated electric wire.

What is claimed is:

1. A compressed stranded conductor comprising:

an inner layer strand having a plurality of conductive wires which are twisted together; and an outer layer strand having a plurality of conductive wires which are arranged around an outer periphery of the inner layer strand and are twisted together so as to form a layer, wherein the inner layer strand and the outer layer strand are compressed;

an inner layer area reduction rate, which is a difference between 100% and a value (%) obtained by dividing a wire cross-sectional area of the conductive wire of the inner layer strand after compression of the inner layer strand by a wire cross-sectional area of the conductive wire of the inner layer strand before compression of the inner layer strand, is 29% or more and 32% or less;

an outer layer area reduction rate, which is a difference between 100% and a value (%) obtained by dividing a wire cross-sectional area of the conductive wire of the outer layer strand after compression of the outer layer strand by a wire cross-sectional area of the conductive wire of the outer layer strand before compression of the outer layer strand, is 6% or more and 11% or less; and a difference between the inner layer area reduction rate and the outer layer area reduction rate is 19% or more and 25% or less.

2. The compressed stranded conductor according to claim 1, wherein an inner layer compression rate, which is a ratio of a value obtained by dividing a weight of the inner layer strand after compression per 1 meter by a specific gravity of material of the conductive wires of the inner layer strand to a value obtained by multiplying a square of a conductor radius of the inner layer strand after compression by π, is 85% or more and 95% or less; and an outer layer compression rate, which is a ratio of a value obtained by dividing a weight of the outer layer strand after compression per 1 meter by a specific gravity of material of the conductive wires of the outer layer strand to a value obtained by subtracting the value obtained by multiplying the square of the conductor radius of the inner layer strand after compression by π from a value obtained by multiplying a square of a conductor radius of the outer layer strand after compression by π, is 89% or more and 95% or less.

3. An insulated electric wire comprising:

the compressed stranded conductor according to claim 1; and an insulator covering a periphery of the compressed stranded conductor.

4. A wire harness comprising:

the insulated electric wire according to claim 3; and another electric wire disposed along the insulated electric wire.

* * * * *